US006752603B2

(12) United States Patent
Murase et al.

(10) Patent No.: US 6,752,603 B2
(45) Date of Patent: Jun. 22, 2004

(54) COMPRESSOR WITH SEALING COAT

(75) Inventors: Masakazu Murase, Kariya (JP); Junya Suzuki, Kariya (JP); Takayuki Imai, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 274 days.

(21) Appl. No.: 10/094,196

(22) Filed: Mar. 8, 2002

(65) Prior Publication Data

US 2002/0127125 A1 Sep. 12, 2002

(30) Foreign Application Priority Data

Mar. 12, 2001 (JP) ..... 2001-068458

(51) Int. Cl.[7] ..... F09B 39/10; F16L 7/00
(52) U.S. Cl. ..... 417/571; 137/375; 251/368
(58) Field of Search ..... 417/560, 569, 417/571; 137/375; 251/368

(56) References Cited

U.S. PATENT DOCUMENTS 4,875,503 A * 10/1989 Heger et al. ..... 137/856
5,890,878 A * 4/1999 Murase et al. ..... 417/222.2
6,589,021 B2 * 7/2003 Kato et al. ..... 417/222.2
2002/0121189 A1 * 9/2002 Murase et al. ..... 92/71
2003/0089223 A1 * 5/2003 Sugioka et al. ..... 92/70

FOREIGN PATENT DOCUMENTS

| | | | | |
|---|---|---|---|---|
| EP | 1041283 | * | 4/2000 | |
| EP | 1008751 | * | 6/2000 | |
| JP | 1-157283 | | 10/1989 | ..... F04B/39/10 |
| JP | 05-099149 | | 4/1993 | ..... F04B/39/10 |
| JP | 09 264254 | * | 1/1998 | |

* cited by examiner

*Primary Examiner*—Charles G. Freay
(74) *Attorney, Agent, or Firm*—Morgan & Finnegan, LLP

(57) ABSTRACT

A compressor has a first housing, a second housing, a valve plate, a suction valve, a discharge valve and a sealing coat. The first housing includes a compression chamber. The second housing includes a suction chamber and a discharge chamber. The valve plate is interposed between the first housing and the second housing. The suction valve is disposed between the first housing and the valve plate. The discharge valve is disposed between the second housing and the valve plate. The valve plate forms a suction port intercommunicating the suction chamber and the compression chamber, and a discharge port intercommunicating the discharge chamber and the compression chamber. The sealing coat made of soft metal is provided between the suction valve and the valve plate, and/or between the discharge valve and the valve plate.

16 Claims, 1 Drawing Sheet

COMPRESSOR WITH SEALING COAT

BACKGROUND OF THE INVENTION

The present invention relates to a compressor and more particularly to a compressor that provides a suction and discharge mechanism, which is constituted of a valve plate, a suction valve and a discharge valve.

FIG. 2 shows a conventional swash plate type compressor around a suction and discharge mechanism. A valve plate 3 is interposed between a cylinder block 1 and a housing 2. The valve plate 3 forms a suction port 6 intercommunicating a cylinder bore 4 and a suction chamber 5, and a discharge port 8 intercommunicating the cylinder bore 4 and a discharge chamber 7. A suction valve 9 is disposed between the cylinder block 1 and the valve plate 3, and opens and closes the suction port 6. A discharge valve 10 is disposed between the housing 2 and the valve plate 3, and opens and closes the discharge port 8. An O-ring 11 is disposed between the cylinder block 1 and the housing 2.

According to the compressor constructed above, fluid in the suction chamber 5 is sucked into the cylinder bore 4 and is compressed and discharged to the discharge chamber 7 by reciprocation of a piston.

To achieve higher compression efficiency, sealing performance between the suction valve 9 and the valve plate 3 and between the discharge valve 10 and the valve plate 3 is required to improve. Alternative refrigerant gas such as carbon dioxide is promoted to be a practical use to deal with environmental problems these days. However, carbon dioxide for using in a compressor as refrigerant gas requires quite a high compression ratio. Therefore, the above-mentioned requirements for sealing performance have been further increasing these days.

SUMMARY OF THE INVENTION

The present invention addresses the above-mentioned problems traceable to a relatively high compression ratio by improving sealing performance between suction and discharge valves and valve plate.

A compressor has a first housing, a second housing, a valve plate, a suction valve, a discharge valve and a sealing coat. The first housing includes a compression chamber. The second housing includes a suction chamber and a discharge chamber. The valve plate is interposed between the first housing and the second housing. The suction valve is disposed between the first housing and the valve plate. The discharge valve is disposed between the second housing and the valve plate. The valve plate forms a suction port intercommunicating the suction chamber and the compression chamber, and a discharge port intercommunicating the discharge chamber and the compression chamber. The sealing coat made of soft metal is provided between the suction valve and the valve plate, and/or between the discharge valve and the valve plate.

The sealing coat made of soft metal inhibits refrigerant gas from leaking through any gap between the suction valve and the valve plate and between the discharge valve plate and the valve plate.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention, which is applied to a swash plate type variable displacement compressor for compressing refrigerant gas, will now be described with reference to FIG. 1.

Figure 1:
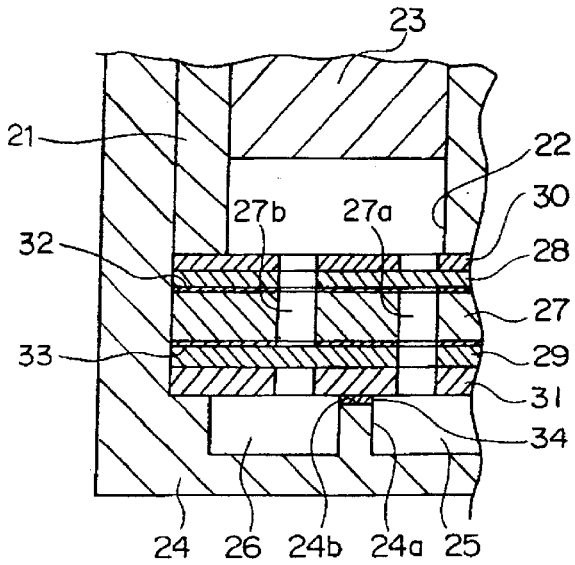
FIG. 1 is a partial cross-sectional view of a piston type compressor around a suction mechanism and a discharge mechanism according to an embodiment of the present invention.
Figure 2:
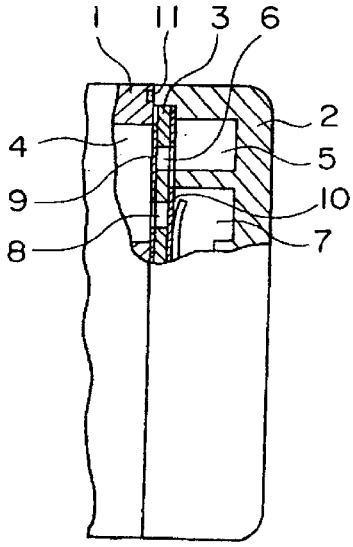
Fig. 2 (PRIOR ART)
FIG. 2 is a side elevational view, partly in cross section, of a conventional piston type compressor around a suction mechanism and a discharge mechanism.

As shown in FIG. 1, a cylinder block 21 or a first housing defines a cylinder bore 22 or a compression chamber inside. The cylinder bore 22 accommodates a piston 23 so as to reciprocate. A housing 24 or a second housing defines a suction chamber 25 and a discharge chamber 26 inside. The cylinder block 21 is fitted into the housing 24, and the cylinder block 21 and the housing 24 sandwich a valve plate 27, a suction valve 28, a discharge valve 29 and a pair of gaskets 30, 31. The valve plate 27 is a flat member made of iron, and forms a suction port 27*a* intercommunicating the cylinder bore 22 and the suction chamber 25, and a discharge port 27*b* intercommunicating the cylinder bore 22 and the discharge chamber 26. The suction valve 28 between the valve plate 27 and the cylinder block 21 is a flat member made of iron, and provides a reed valve, which opens and closes the suction port 27*a*. The discharge valve 29 between the valve plate 27 and the housing 24 is a flat member made of iron, and provides a reed valve, which opens and closes the discharge port 27*b*. Gaskets 30, 31 are disposed between the suction valve 28 and the cylinder block 21 and between the discharge valve 29 and the housing 24, respectively.

Sealing coats 32, 33 made of soft metal, that is, tin in the present embodiment, are disposed between the suction valve 28 and the valve plate 27 and between the discharge valve 29 and the valve plate 27, respectively. The sealing coats 32, 33 are films formed by coating the surfaces of the valve plate 27. Also, the housing 24 includes a partition wall 24*a*, which separates the suction is chamber 25 and the discharge chamber 26. Another sealing coat 34 made of soft metal, that is, tin in the present embodiment, is disposed between the sealing end 24*b* of the partition wall 24*a* and the gasket 23. The sealing coat 34 is a film, which is formed by coating the sealing end 24*b*. Besides, the sealing coats 32, 33, 34 in FIG. 1 are exaggerated illustrated to understand easily. Ratios of the size of the sealing coats 32, 33, 34 to the other components do not reflect practical sizes.

The piston type compressor constructed above will now be described. Due to motion that the piston 23 moves from a top dead center toward a bottom dead center, refrigerant gas in the suction chamber 25 flows into the cylinder bore 22 through the suction port 27*a* of the valve plate 27 as pushes the valve body of the suction valve 28 aside. Due to motion that the piston 23 moves from the bottom dead center toward the top dead center, the refrigerant gas flows into the discharge chamber 26 through the discharge port 27*b* of the valve plate 27 as pushes a reed valve of the discharge valve 29 aside. Since the sealing coats 32, 33 made of tin, which performs high wettability for metal, are formed on the surfaces of the valve plate 27, sealing performance between the suction valve 28 and the valve plate 27 and between the discharge valve and the valve plate 27 improves without disposing another member such as a gasket. Even if pressure of refrigerant gas such as carbon dioxide is high, the refrigerant gas leaking along the valve plate 27 is inhibited, and compression efficiency improves.

Even if sealing performance may not improved by disposing an O-ring between the cylinder block and the housing around the valve plate adjacent the outside periphery, the sealing coats 32, 33 inhibits the refrigerant gas leaking along the valve plate 27, and sealing performance about the outside periphery of the valve plate 27 improves.

When pressure of refrigerant gas such as carbon dioxide is high, sealing performance about the partition wall 24 between the suction chamber 25 and the discharge chamber 26, where pressure differential is large, is required. However, in the present embodiment, since the sealing coat 34 made of tin, which performs high wettability for metal, is formed on the sealing end 24*b* of the partition wall 24*a*, sealing performance between the suction chamber 25 and the discharge chamber 26 improves. Thereby, the leakage of the refrigerant gas is inhibited, and compression efficiency improves.

The present invention is not limited to the embodiment described above, but may be modified into the following examples. The sealing coat is not limited to the tin sealing coat. For example, other soft metals, which performs high wettability for metal such as lead and zinc may be applied. Also, a position coated with the sealing coat, which is made of soft metal, is not limited to the valve plate. The sealing coat may coat the suction valve and/or the discharge valve.

According to the present invention described above, the compressor provides the sealing coat, which is made of soft metal, between the suction valve and the valve plate and between the discharge valve and the valve plate. Thereby, sealing performance therebetween improves without disposing another member such as a gasket.

Also, when the sealing end of the partition wall separating the suction chamber and the discharge chamber provides the sealing coat, which is made of soft metal, sealing performance between the suction chamber and the discharge chamber, where pressure differential is large, improves, and compression efficiency improves.

Therefore, the present examples and embodiments are to be considered as illustrative and not restrictive and the invention is not to be limited to the details given herein but may be modified within the scope of the appended claims.

What is claimed is:

1. A compressor comprising:

a first housing including a compression chamber;

a second housing including a suction chamber and a discharge chamber;

a valve plate interposed between the first housing and the second housing, forming a suction port intercommunicating the suction chamber and the compression chamber, and forming a discharge port intercommunicating the discharge chamber and the compression chamber;

a suction valve disposed between the first housing and the valve plate;

a discharge valve disposed between the second housing and the valve plate; and a sealing coat made of soft metal, provided between the suction valve and the valve plate, and/or between the discharge valve and the valve plate.

2. The compressor according to claim 1, wherein the first housing is a cylinder block accommodating a piston, the piston reciprocates in the compression chamber, and the cylinder block is fitted into the second housing.

3. The compressor according to claim 1, wherein the second housing provides a partition wall separating the suction chamber and the discharge chamber, and the end of the partition wall provides the sealing coat.

4. The compressor according to claim 1, wherein the sealing coat is made of one of tin, lead and zinc.

5. The compressor according to claim 1, wherein the compressor is a variable displacement type compressor.

6. The compressor according to claim 1, wherein the compressor is a swash plate type.

7. The compressor according to claim 1, wherein the compressor is a piston type.

8. The compressor according to claim 1, wherein the refrigerant gas used in is the compressor is carbon dioxide.

9. A compressor comprising:

a first housing including a compression chamber;

a second housing including a suction chamber and a discharge chamber, the second housing providing a partition wall separating the suction chamber and the discharge chamber;

valve plate interposed between the first housing and the second housing, forming a suction port intercommunicating the suction chamber and the compression chamber, and forming a discharge port intercommunicating the discharge chamber and the compression chamber;

a suction valve disposed between the first housing and the valve plate;

a discharge valve disposed between the second housing and the valve plate; and a sealing coat made of soft metal provided on the end of the partition wall.

10. The compressor according to claim 9, wherein the sealing coat is further provided between the suction valve and the valve plate, and/or between the discharge valve and the valve plate.

11. The compressor according to claim 9, wherein the first housing is a cylinder block accommodating a piston, the piston reciprocates in the compression chamber, and the cylinder block is fitted into the second housing.

12. The compressor according to claim 9, wherein the sealing coat is made of one of tin, lead and zinc.

13. The compressor according to claim 9, wherein the compressor is a variable displacement type compressor.

14. The compressor according to claim 9, wherein the compressor is a piston type.

15. The compressor according to claim 9, wherein the compressor is a swash plate type.

16. The compressor according to claim 9, wherein the compressor is a swash plate type.

* * * * *